US007641203B1

(12) United States Patent
Carey et al.

(10) Patent No.: US 7,641,203 B1
(45) Date of Patent: Jan. 5, 2010

(54) TRIPLE-BLADE ICE SKATING FOOTWEAR AND ASSOCIATED METHOD

(76) Inventors: Kevin Carey, 3359 Liberty St., Browns Mills, NJ (US) 08015; Veronika Lawson, 3359 Liberty St., Browns Mills, NJ (US) 08015

( * ) Notice: Subject to any disclaimer, the term of this patent is extended or adjusted under 35 U.S.C. 154(b) by 116 days.

(21) Appl. No.: 12/151,926

(22) Filed: May 9, 2008

Related U.S. Application Data

(60) Provisional application No. 60/930,016, filed on May 14, 2007.

(51) Int. Cl.
*A63C 1/36* (2006.01)

(52) U.S. Cl. ..... 280/11.12; 280/11.16

(58) Field of Classification Search ..... 280/841, 280/11.12, 8, 9, 10, 11, 11.16, 11.19, 11.26, 280/11.28, 811, 13, 14, 28.16
See application file for complete search history.

(56) References Cited

U.S. PATENT DOCUMENTS 2,216,438 A * 10/1940 Hamilton ..... 280/11.12
2,867,445 A * 1/1959 Lachat ..... 280/11.12
2,920,897 A * 1/1960 Jensen ..... 280/11.12
3,120,397 A * 2/1964 Zwahlen et al. ..... 280/11.12
3,695,609 A 10/1972 Rothe
4,407,522 A 10/1983 Suroff
4,418,928 A 12/1983 Cox
6,612,592 B1 * 9/2003 Soo ..... 280/11.16
6,786,493 B2 * 9/2004 Hong ..... 280/11.26

* cited by examiner

*Primary Examiner*—Lesley Morris
*Assistant Examiner*—John D Walters

(57) ABSTRACT

A multi-blade ice-skate footwear includes a foot-retaining section with a substantially planar bottom surface, a first blade adjustably connected to an anterior portion of the bottom surface, and second and third blades adjustably connected to a posterior portion of the bottom surface and spaced from the first blade respectively. The ice-skate footwear includes a mechanism for selectively biasing the first blade along a first reciprocating linear path while simultaneously biasing the second and third blades along second and third reciprocating linear paths respectively.

18 Claims, 9 Drawing Sheets

TRIPLE-BLADE ICE SKATING FOOTWEAR AND ASSOCIATED METHOD

CROSS REFERENCE TO RELATED APPLICATIONS

This application claims the benefit of U.S. Provisional Application No. 60/930,016, filed May 14, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to ice-skating footwear and, more particularly, to a triple-blade ice-skating footwear for assisting a novice user to maintain balance and stability during ice-skating procedures.

2. Prior Art

The typical ice skate known in the prior art generally includes a single narrow blade extending longitudinally and depending subjacent from a shoe or boot secured to the foot of the skater. Although this construction suffices for a great number of skaters, it is well recognized that many individuals are not capable of using and enjoying the typical single blade skate. The single blade skate establishes a very narrow support base upon which a comparatively wide load must be supported. As a result, there is an inherent instability in this overall arrangement. This instability can be overcome by individuals having relatively strong and rigid ankle joints, as well as a keen sense of balance. For an individual lacking these attributes, skating can be a perilous and unpleasant pastime.

There are known in the prior art various skate constructions which attempt to overcome the deficiencies of the single blade skate. These constructions generally comprise various forms of double blade skates in which a pair of longitudinally extending blades is laterally spaced to provide a wider base of support. However, the effect of enhanced stability is created only when both of the blades are in contact with the ice. Due to the fact that the pair of blades is generally not widely spaced apart, an individual having weak ankles will cause the skate to roll about a longitudinal axis, resulting in only one blade contacting the ice. Thus the skater still will experience severe problems in balance and control. Based on the above mentioned needs, it would be advantageous to provide a means for assisting a beginning skater to skate confidently and safely.

U.S. Pat. No. 3,695,609 to Rothe discloses a skating aid formed by bending two base sections to form a runner and a vertical support section. The vertical support sections are joined to fix the runners apart and generally coextensive. A handle is attached to the vertical support section and can be formed integrally therewith. Wheels can be attached to the runners. The aid is useful in training persons to ice skate or roller skate. Unfortunately, this prior art example is not customized to help students learn to skate based on the standard design of the ice skates themselves.

U.S. Pat. No. 4,407,522 to Suroff discloses a energy saving ice skate attachment device for attachment to an ice skate, or the like, also suitable for training skaters, includes an elongated frame with a pair of outboard blades having its edge portion coplanar with the blade of the ice skate, is clamped to the ice skate by means of a U-shaped clamping device which affixes the frame of the attachment device to the shoe supporting post of the ice skate. Resilient means are disposed between the horizontal portion of the attachment device frame and the underside of the ice skate shoe, thereby permitting at least two blades to contact the surface of the ice even during turns, thereby reducing the energy needed to utilize the skates. Unfortunately, this prior art example does not provide the balance and confidence needed to develop ice-skating skills.

U.S. Pat. No. 4,418,928 to Cox discloses a ice skate that provides exceptional lateral stability and includes a boot having a sole plate extending longitudinally between the toe portion and the heel portion of the boot. A pair of adjustable shock absorbing mounting assemblies is joined to the toe portion and the heel portion of the sole plate. A pair of ice engaging members is provided, each secured to one of the shock absorber mounting assemblies. The ice engaging members extend transversely with respect to the longitudinal axis of the boot to provide high lateral stability. Projecting downwardly from the lower surfaces of the ice engaging members is a plurality of laterally spaced, longitudinally extending ribs which are adapted to slide on ice. Unfortunately, this prior art example is not customized to help students learn to skate based on the standard design of the ice skates themselves.

Accordingly, the present invention is disclosed in order to overcome the above noted shortcomings. The device is convenient and easy to use, lightweight yet durable in design, and designed for assisting a novice user to maintain balance and stability during ice-skating procedures. The multi-blade ice-skate footwear is simple to use, inexpensive, and designed for many years of repeated use.

BRIEF SUMMARY OF THE INVENTION

In view of the foregoing background, it is therefore an object of the present invention to provide a device for assisting a novice user to maintain balance and stability during ice-skating procedures. These and other objects, features, and advantages of the invention are provided by a multi-blade ice-skate footwear.

A multi-blade ice-skate footwear includes a foot-retaining section with a substantially planar bottom surface, a first blade adjustably connected to an anterior portion of the bottom surface, and second and third blades adjustably connected to a posterior portion of the bottom surface and effectively spaced from the first blade respectively.

The device includes a mechanism for selectively biasing the first blade along a first reciprocating linear path while simultaneously biasing the second and third blades along second and third reciprocating linear paths respectively. Such second and third linear reciprocating paths are mutually exclusive and non-overlapping with the first linear reciprocating path, and the second and third linear reciprocating paths are conveniently registered orthogonal to the first linear reciprocating path respectively. The first reciprocating linear path is equal to the second and third reciprocating linear paths respectively, and the selectively biasing mechanism automatically displaces the first blade along the bottom surface while synchronously displacing the second and third blades along the bottom surface and thereby proportionally adjusts the ice-skate footwear between a low-speed mode and a high-speed mode based upon a single user input.

The high-speed mode is advantageously defined when the first blade is linearly displaced to a fully extended anterior position while the second and third reciprocating linear paths have respective maximum values defined between the second and third blades and the lateral sides respectively. The low-speed mode is defined when the first blade is linearly displaced to a fully retracted posterior position while the second and third reciprocating linear paths have a minimum value between the second and third blades and the lateral sides respectively.

The selectively biasing mechanism includes a rotary dial configured along an exterior wall of the foot-retaining section, and a first linear shaft is statically coupled to the rotary dial and is rotated in sync therewith. Such a first linear shaft effectively has a threaded outer surface extending along a longitudinal length thereof and is oriented at a first angular direction. A rotary gear is statically coupled to a distal end of the first linear shaft and is rotated in sync therewith. Such a rotary gear has a toothed outer circumference and further is medially interposed between the first and second blades.

The selectively biasing mechanism further includes a second linear shaft statically coupled to the rotary gear and rotated in sync therewith. Such a second linear shaft conveniently has a threaded outer surface extending along a longitudinal length thereof and oriented at a second angular direction, and is further oriented parallel to the first linear shaft. First and second stabilizing rods are connected to the lateral sides of the bottom surface and are registered orthogonal to the second and third blades respectively. Such second and third blades linearly reciprocate along the second and third reciprocating linear paths when the rotary dial is articulated along an arcuate path respectively such that the second and third blades simultaneously travel towards and away from the rotary gear when the rotary dial is articulated along clockwise and counter clockwise directions respectively.

The selectively biasing mechanism further includes a rectilinear track advantageously formed along the bottom surface of the foot-retaining section, and a third shaft operably and directly mated with the rotary gear in such a manner that the third shaft is linearly reciprocated along the track and the first reciprocating linear path when the rotary gear is articulated along clockwise and counter clockwise directions respectively.

A method for assisting a novice user to maintain balance and stability during ice-skating procedures includes the steps of: providing a foot-retaining section having a substantially planar bottom surface; providing and adjustably connecting a first blade to an anterior portion of the bottom surface; providing and adjustably connecting second and third blades to a posterior portion of the bottom surface by spacing the second and third blades from the first blade respectively; and selectively biasing the first blade along a first reciprocating linear path while simultaneously biasing the second and third blades along second and third reciprocating linear paths respectively. The second and third linear reciprocating paths are mutually exclusive and non-overlapping with the first linear reciprocating path, and the second and third linear reciprocating paths are registered orthogonal to the first linear reciprocating path respectively.

The method further includes the steps of: automatically displacing the first blade along the bottom surface while synchronously displacing the second and third blades along the bottom surface; and proportionally adjusting the ice-skate footwear between a low-speed mode and a high-speed mode based upon a single user input. The first reciprocating linear path is equal to the second and third reciprocating linear paths respectively.

The method further includes the step of the adapting the ice-skate to the high-speed mode by linearly displacing the first blade to a fully extended anterior position while the second and third reciprocating linear paths have respective maximum values defined between the second and third blades and the lateral sides respectively. The method further includes the step of adapting the ice-skate footwear to the low-speed mode by linearly displacing the first blade to a fully retracted posterior position while the second and third reciprocating linear paths have a minimum value between the second and third blades and the lateral sides respectively.

The method further includes the steps of: providing and configuring a rotary dial along an exterior wall of the foot-retaining section; and providing and statically coupling a first linear shaft to the rotary dial such that the first linear shaft is rotatable in sync therewith. The first linear shaft has a threaded outer surface extending along a longitudinal length thereof and is oriented at a first angular direction. The steps further include: providing and statically coupling a rotary gear to a distal end of the first linear shaft such that the rotary gear is rotatable in sync therewith. The rotary gear has a toothed outer circumference and further is medially interposed between the first and second blades. The steps further include: providing and statically coupling a second linear shaft to the rotary gear such that the second linear shaft is rotatable in sync therewith. The second linear shaft has a threaded outer surface extend along a longitudinal length thereof and is oriented at a second angular direction, and is further oriented parallel to the first linear shaft.

The steps further include: providing and connecting first and second stabilizing rods to the lateral sides of the bottom surface such that the first and second stabilizing rods are registered orthogonal to the second and third blades respectively; and linearly reciprocating the second and third blades linearly reciprocate along the second and third reciprocating linear paths by articulating the rotary dial along an arcuate path respectively such that the second and third blades simultaneously travel towards and away from the rotary gear when the rotary dial is articulated along clockwise and counter clockwise directions respectively.

The method further includes the steps of: providing a rectilinear track formed along the bottom surface of the foot-retaining section; providing and operably mating a third shaft directly with the rotary gear in such a manner; and articulating the rotary gear along clockwise and counter clockwise directions respectively and thereby linearly reciprocating the third shaft along the track and the first reciprocating linear path.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
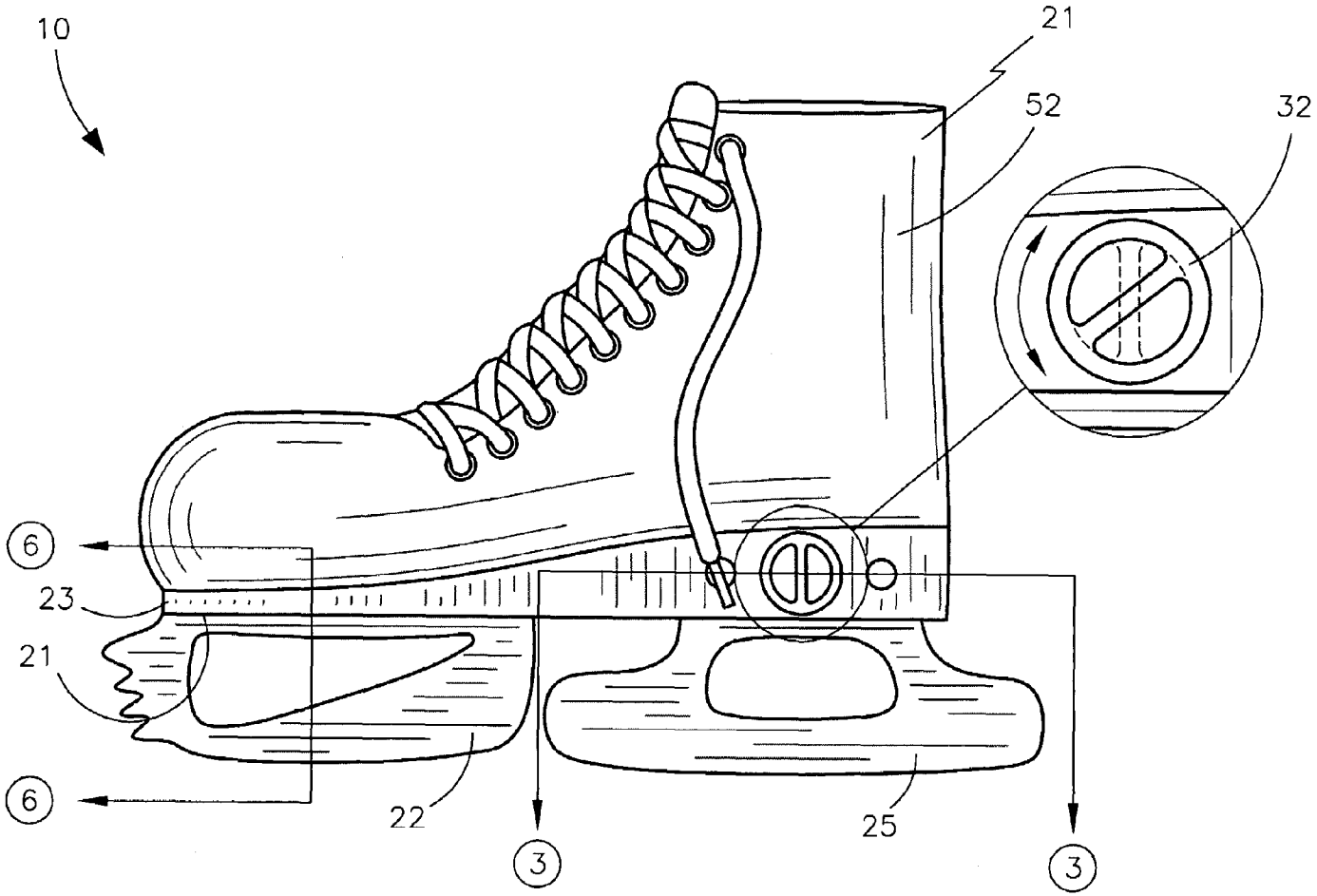
FIG. 1 is a side elevational view of a multi-blade ice-skate, with an enlarged view of a rotary dial, in accordance with the present invention.
Figure 2A:
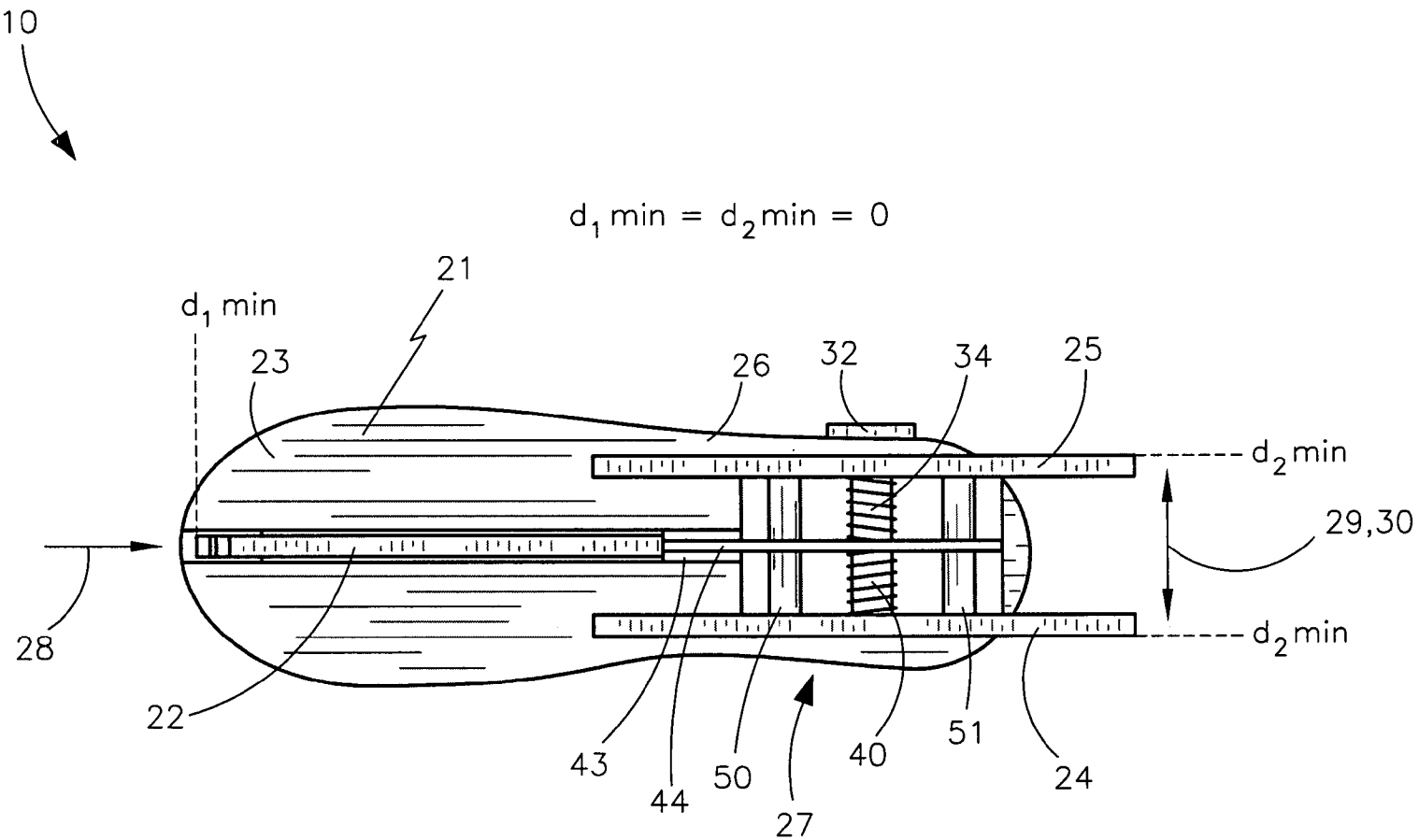
FIG. 2*a* is a bottom plan view of the multi-blade ice-skate as seen in FIG. 1, showing first, second and third blades at equilibrium, or slow-speed mode, in accordance with the present invention.
Figure 2B:
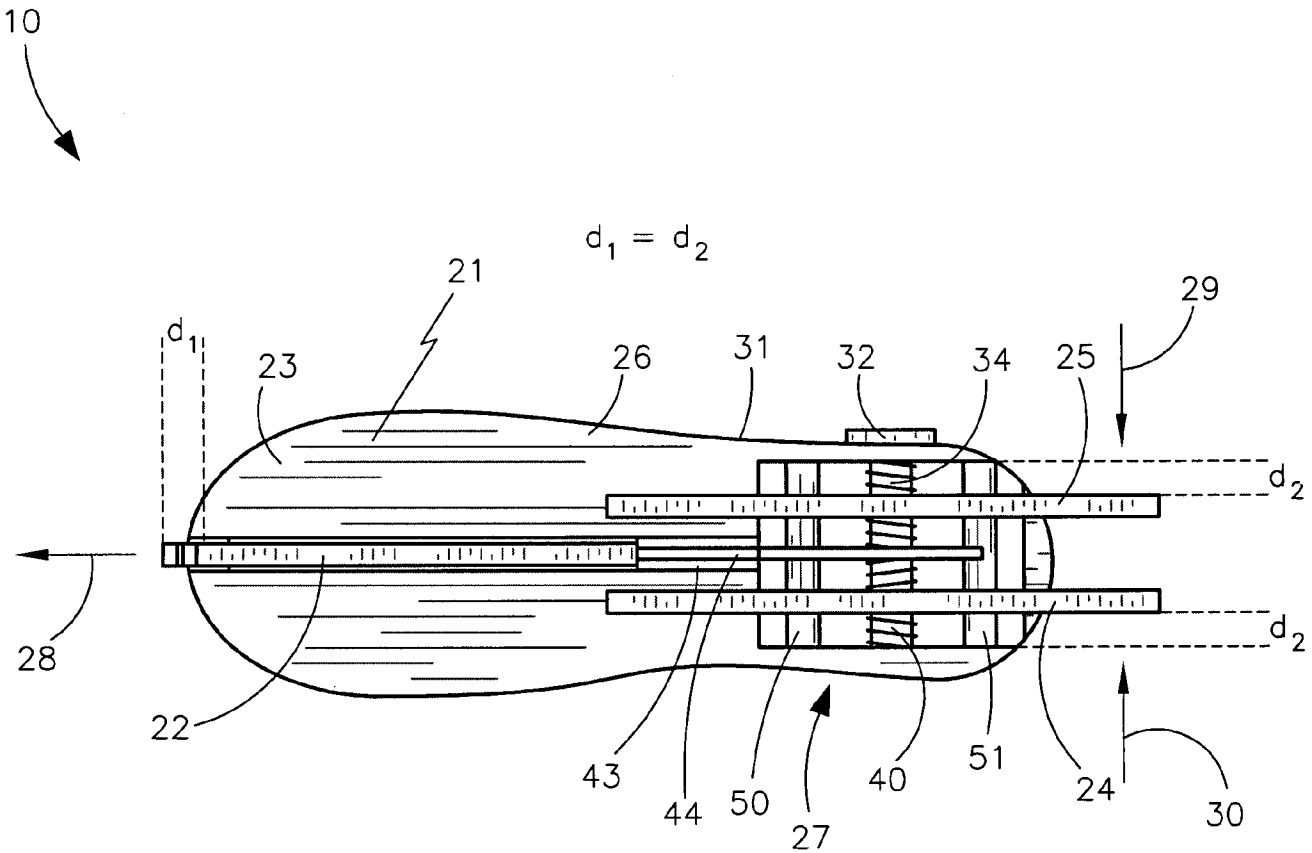
FIG. 2*b* is a bottom plan view of the multi-blade ice-skate as seen in FIG. 2*a*, showing the movement of the first, second and third blades along the first, second and third linear paths, respectively.
Figure 2C:
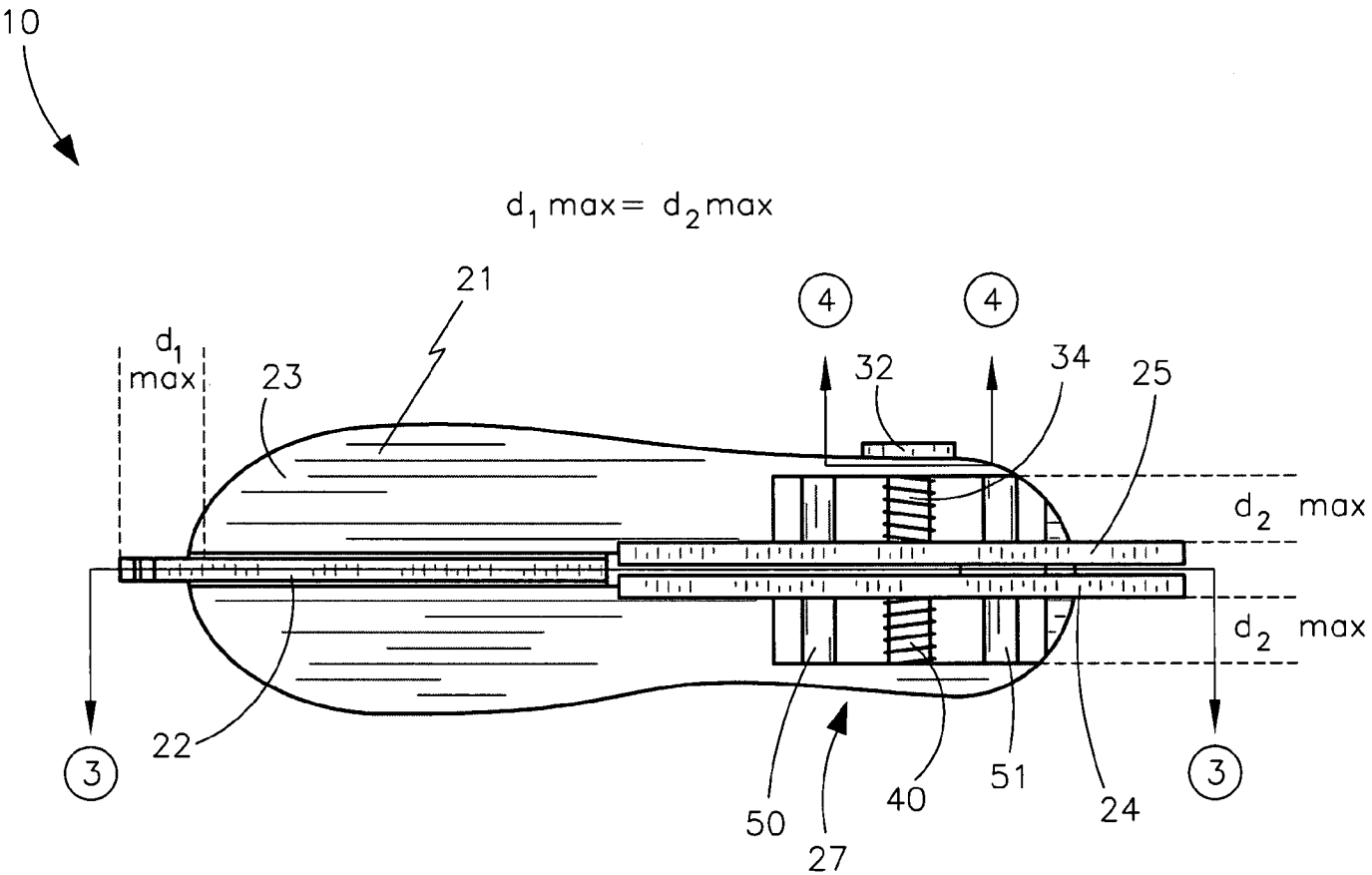
FIG. 2*c* is a bottom planar view of the multi-blade ice-skate as seen in FIG. 2*b*, showing the apparatus in a high-speed mode, in accordance with the present invention.
Figure 3:
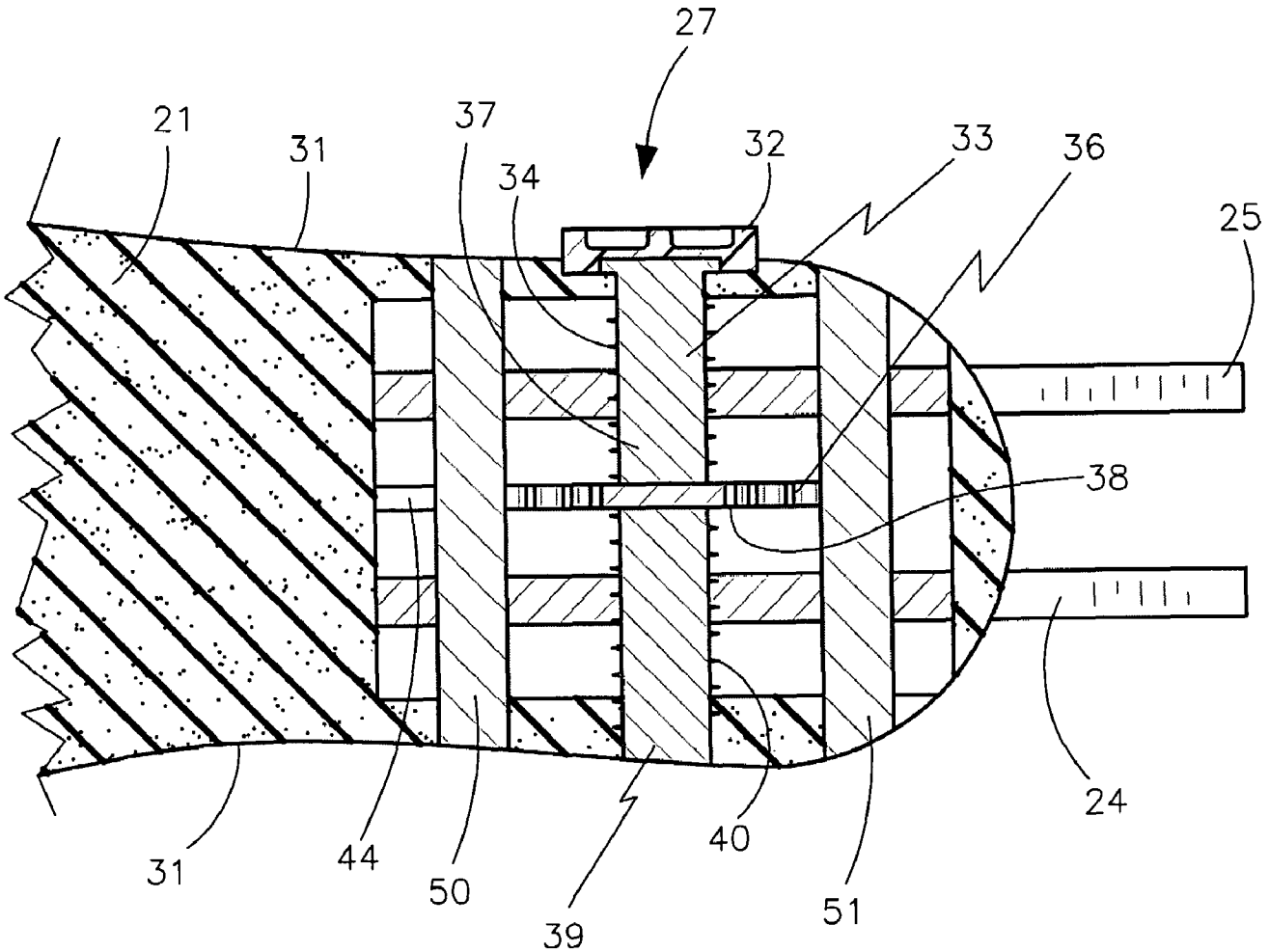
FIG. 3 is a cross sectional view of a selectively biasing mechanism, taken along line 3-3, as seen in FIG. 1.
Figure 4:
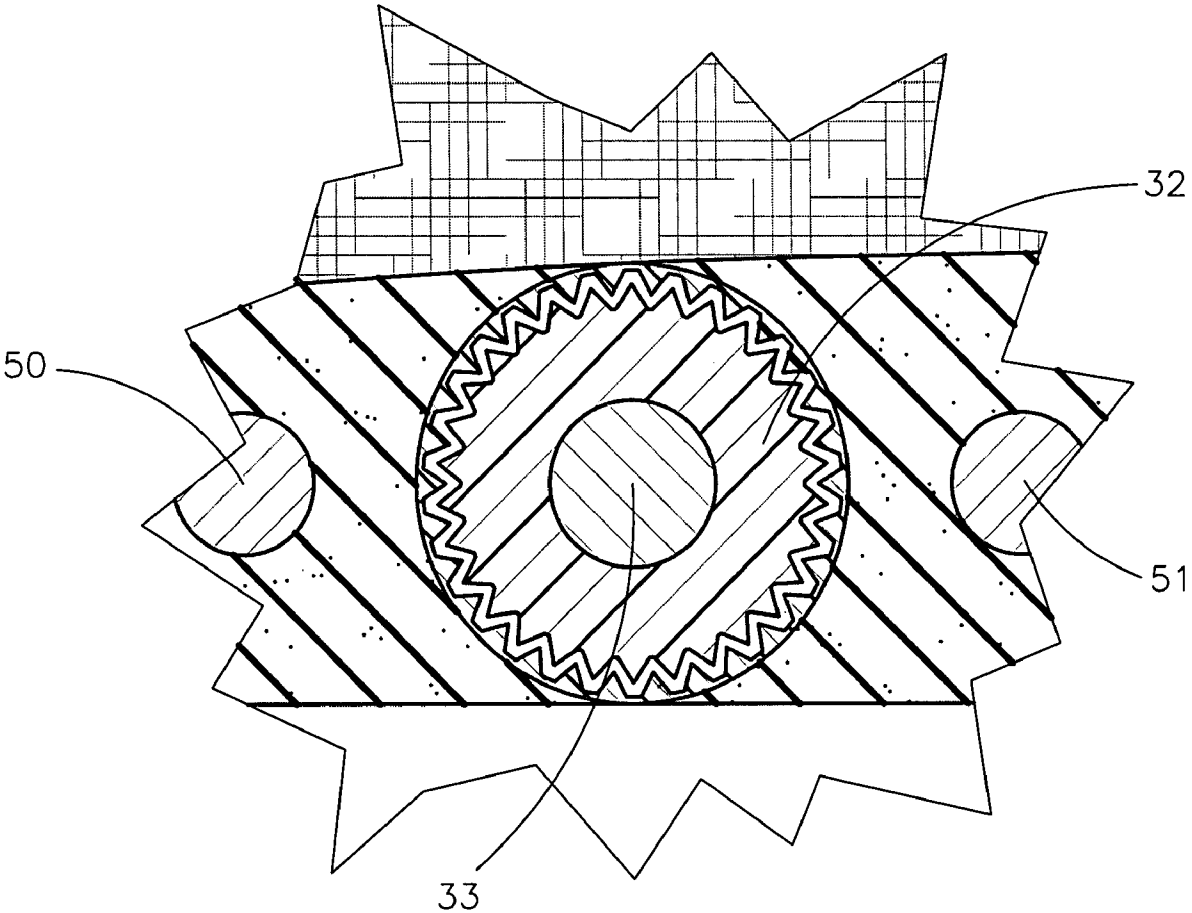
FIG. 4 is an enlarged cross sectional view of the rotary dial, taken along line 4-4, as seen in FIG. 2*c;*
Figure 5A:
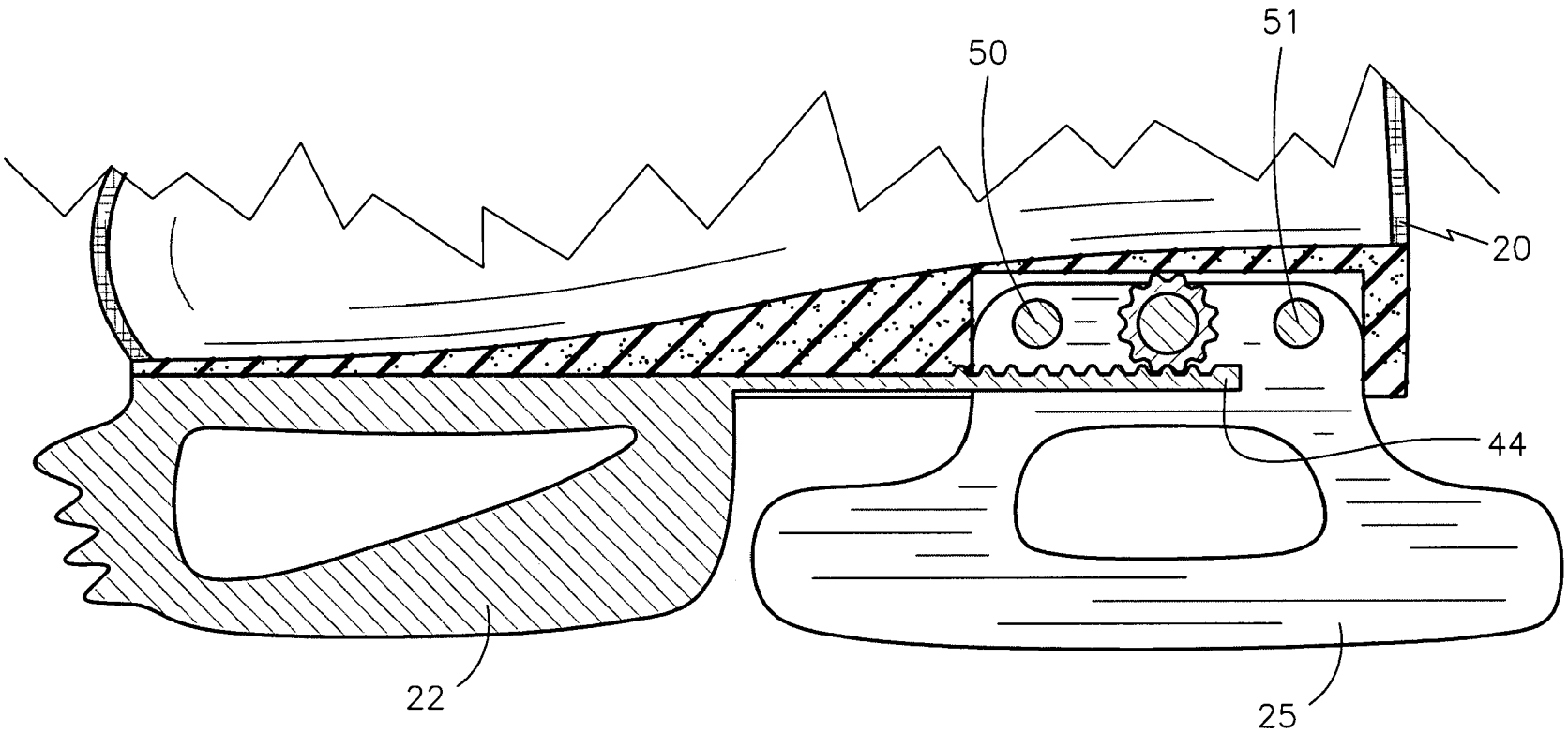
FIG. 5*a* is a cross sectional view of the multi-blade ice-skate, showing the first, second and third blades in equilibrium position, in accordance with the present invention.
Figure 5B:
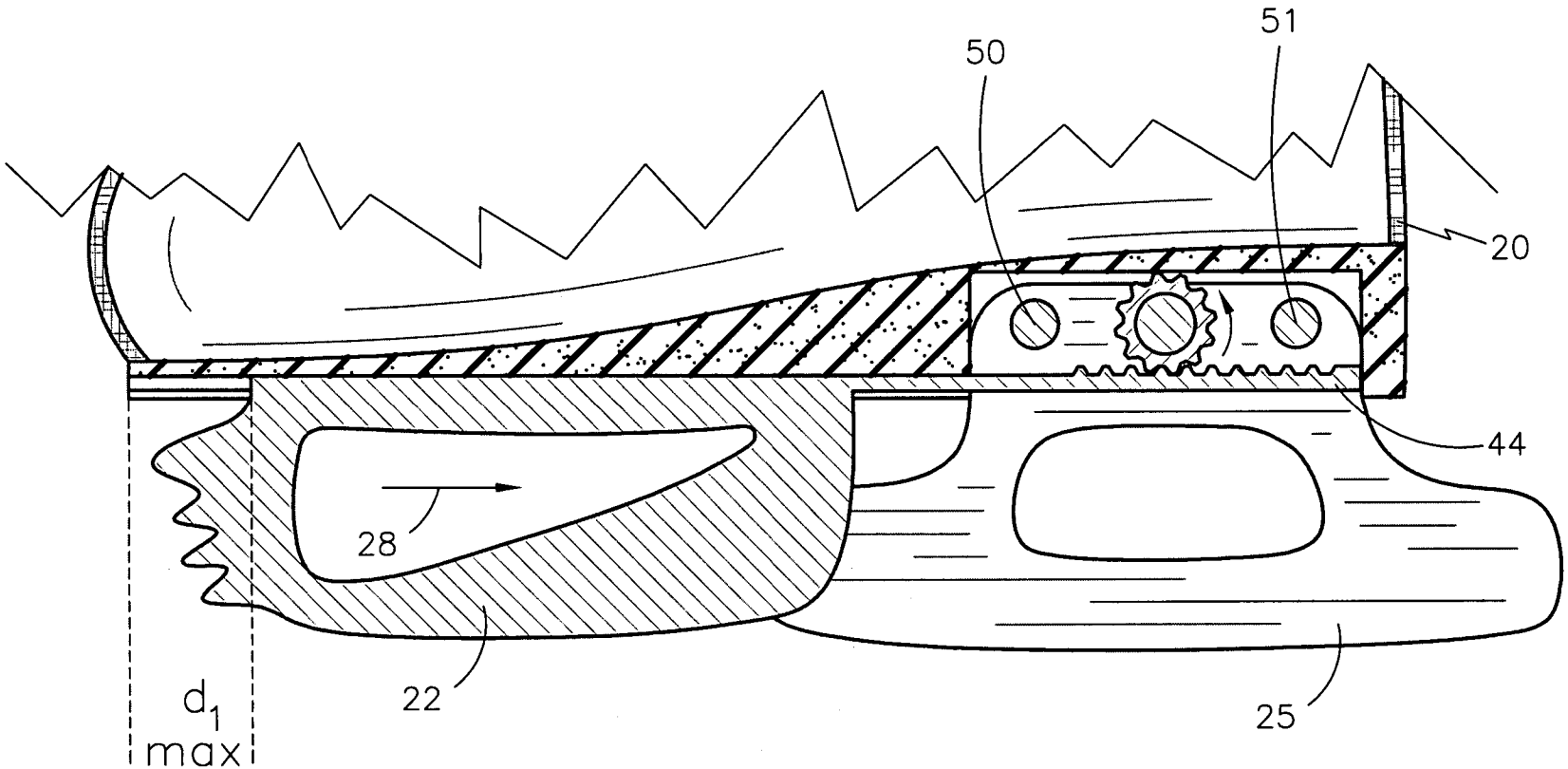
FIG. 5*b* is a cross sectional view of the present invention, showing the first, second and third blades in the high-speed mode, in accordance with the present invention.
Figure 6:
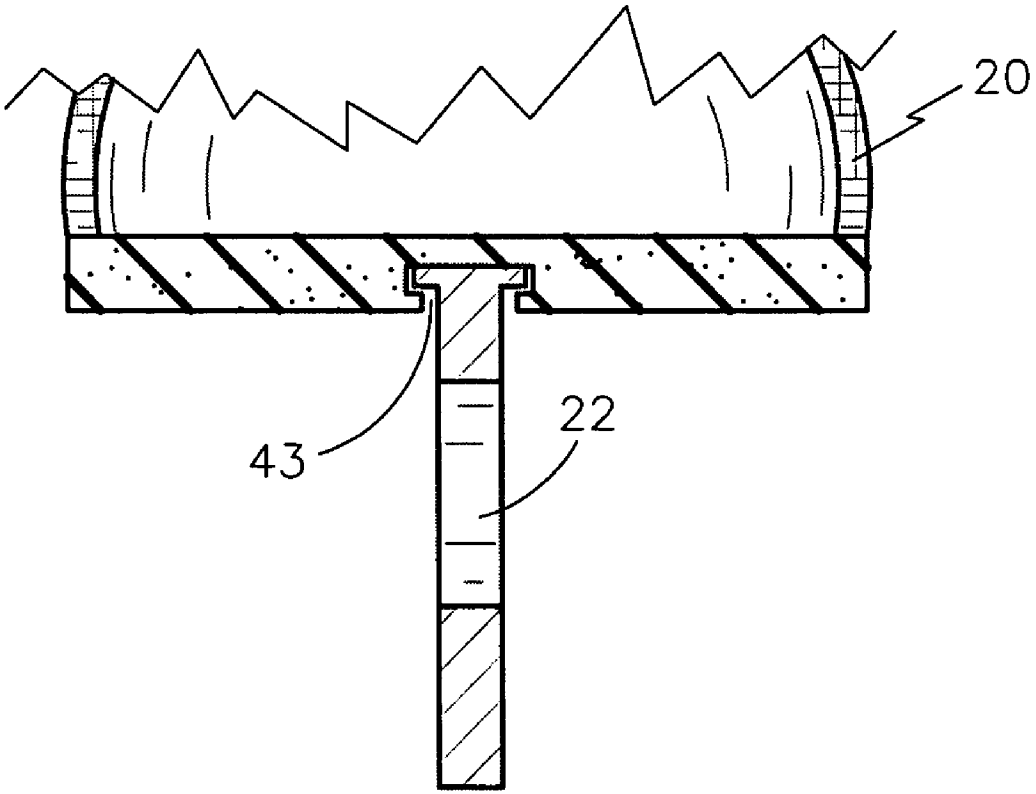
FIG. 6 is a cross sectional view of the first blade and an anterior portion of a bottom surface of the ice-skate, taken along line 6-6, as seen in FIG. 1.

The device of this invention is referred to generally in FIGS. 1-6 by the reference numeral 10 and is intended to provide a multi-blade ice-skate footwear. It should be understood that the device 10 may be used for many different types of ice-skating footwear and should not be limited to use with only those types of ice-skating footwear mentioned herein.

Referring initially to FIGS. 1, 2*a*, 2*b*, 2*c*, 3, 5*a*, 5*b*, 5*c* and 6, a multi-blade ice-skate footwear 10 includes a foot-retaining section 20 with a substantially planar bottom surface 21, a first blade 22 adjustably connected to an anterior portion 23 of the bottom surface 21, and second and third blades 24, 25 adjustably connected to a posterior portion 26 of the bottom surface 21 and spaced from the first blade 22 respectively. The combination of such first, second and third blades provide an unpredictable and unexpected result which is not rendered obvious by one skilled in the art. For example, unlike standard single-blade ice-skates, the three blades provided in the multi-blade ice-skate enable a user to adjust the blades according to their skating proficiency level.

Referring to FIGS. 2*a*, 2*b*, 2*c*, 3 and 4, the device 10 includes a mechanism 27 for selectively biasing the first blade 22 along a first reciprocating linear path 28 while simultaneously biasing the second and third blades 24, 25 along second and third reciprocating linear paths 29, 30 respectively. Such second and third linear reciprocating paths 29, 30 are mutually exclusive and non-overlapping with the first linear reciprocating path 28, and the second and third linear reciprocating paths 29, 30 are registered orthogonal to the first linear reciprocating path 28 respectively. The first reciprocating linear path 28 is equal to the second and third reciprocating linear paths 29, 30 respectively, and the selectively biasing mechanism 27 automatically displaces the first blade 22 along the bottom surface 21 while synchronously displacing the second and third blades 24, 25 along the bottom surface and thereby proportionally adjusts the ice-skate footwear 10 between a low-speed mode and a high-speed mode based upon a single user input.

The high-speed mode is defined when the first blade 22 is linearly displaced to a fully extended anterior position while the second and third reciprocating linear paths 29, 30 have respective maximum values defined between the second and third blades 24, 25 and the lateral sides 31 respectively. The low-speed mode is defined when the first blade 22 is linearly displaced to a fully retracted posterior position while the second and third reciprocating linear paths 29, 30 have a minimum value between the second and third blades 24, 25 and the lateral sides 31 respectively. The selectively biasing mechanism 27 provides an unpredictable and unexpected result which is not rendered obvious by one skilled in the art. For example, the mechanism 27 enables a user to adjust the three blades to low-speed and high-speed modes according to the needs of the particular user. Advantageously, the multi-blade ice-skates may be used by both beginners and proficient skaters, simply by adjusting the selectively biasing mechanism 27 to the proper position.

In a preferred embodiment of the present invention, the selectively biasing mechanism 27 includes a rotary dial 32 configured along an exterior wall 52 of the foot-retaining section 20, and a first linear shaft 33 is statically coupled to the rotary dial 32 and is rotated in sync therewith. Such a first linear shaft 33 has a threaded outer surface 34 extending along a longitudinal length thereof and is oriented at a first angular direction. A rotary gear 36 is statically coupled to a distal end 37 of the first linear shaft 33 and is rotated in sync therewith. Such a rotary gear 36 has a toothed outer circumference 38 and further is medially interposed between the first and second blades 22, 34.

Referring to FIGS. 2*a*, 2*b*, 2*c*, 3, 4, 5*a*, 5*b* and 6, the selectively biasing mechanism 27 further includes a second linear shaft 39 statically coupled to the rotary gear 36 and rotated in sync therewith. Such a second linear shaft 39 has a threaded outer surface 40 extending along a longitudinal length thereof and oriented at a second angular direction, and is further oriented parallel to the first linear shaft 33. First and second stabilizing rods 50, 51 are connected to the lateral sides 31 of the bottom surface 21 and are registered orthogonal to the second and third blades 24, 25 respectively. Such second and third blades 24, linearly reciprocate along the second and third reciprocating linear paths 29, when the rotary dial 32 is articulated along an arcuate path respectively which is essential such that the second and third blades 29, 30 simultaneously travel towards and away from the rotary gear 36 when the rotary dial 32 is articulated along clockwise and counter clockwise directions respectively.

The selectively biasing mechanism 27 further includes a rectilinear track 43 formed along the bottom surface 21 of the foot-retaining section 20, and a third shaft 44 operably and directly mated, without the use of intervening elements, with the rotary gear 36 in such a manner that the third shaft 44 is linearly reciprocated along the track 43 and the first reciprocating linear path 28 when the rotary gear 36 is articulated along clockwise and counter clockwise directions respectively.

The present invention includes three blades 22, 24, 25 as opposed to one long blade. The first blade is centrally located at the toe, featuring the standard shape and serrated stopper tip. The benefit of the two parallel second and third blades 24, 25 on the heel provides stability for small children and beginners. Resembling standard skates, the present invention may be constructed of durable vinyl uppers with reinforced box toes, nylon tricot lining and poly-foam insulation, two piece form fitting tongues, bell backstays, and long orthopedic counters. The three blades 22, 24, 25, as described above, may be hollow ground hardened and tempered zinc plated steel blades, as an example, and already may come sharpened to perfection upon purchase.

Sold in pairs, the skates 10 will be offered in a variety of sizes appropriate for men, women, and children, and also feature a wide array of attractive colors to appeal to individual tastes. After achieving the proper balance, skaters are able to graduate to standard skates, and are better able to attain the flawless execution of slightly leaning the blade over and gigging one of its edges into the ice ('rockover and bite'), which gives skaters the ability to increase friction and control movement at will.

In addition, by choosing to move along curved paths while leaning and flexing the knees, skaters can effortlessly use gravity to control and increase momentum. Users can also create momentum by pushing the blades 22, 24, 25 against the curved track which it cuts into the ice. Skillfully combining these two actions of leaning and pushing, a technique known as drawing, results in what looks like effortless and graceful curvilinear flow across the ice.

The present invention, as claimed, provides the unexpected and unpredictable benefit of an ice-skating footwear that is convenient and easy to use, is lightweight yet durable in design, and assists a beginning skater to skate confidently and safely. The skate 10 provides the balance and confidence needed to develop ice-skating skills. Such a skate 10 is safer for a beginning skater by providing a more stable platform for the skater rest upon, thereby decreasing worry for a parent of a beginning skater, and also decreasing the injuries commonly associated with learning to skate with traditional ice skates. In addition, the skate 10 provides an opportunity for those who skate infrequently to enjoy the activity on those occasions when others are skating. The present invention is simple to use, inexpensive, safe, and designed for many years of repeated use.

In use, a method for assisting a novice user to maintain balance and stability during ice-skating procedures includes the steps of: providing a foot-retaining section 20 having a substantially planar bottom surface 21; providing and adjustably connecting a first blade 22 to an anterior portion 23 of the bottom surface 21; providing and adjustably connecting second and third blades 24, 25 to a posterior portion 26 of the bottom surface 21 by spacing the second and third blades 24, 25 from the first blade 22 respectively; and selectively biasing the first blade 22 along a first reciprocating linear path 28 while simultaneously biasing the second and third blades 24, 25 along second and third reciprocating linear paths 29, 30 respectively. The second and third linear reciprocating paths 29, 30 are mutually exclusive and non-overlapping with the first linear reciprocating path 28, and the second and third linear reciprocating paths 29, 30 are registered orthogonal to the first linear reciprocating path 28 respectively.

In use, the method further includes the steps of: automatically displacing the first blade 22 along the bottom surface while synchronously displacing the second and third blades 24, 25 along the bottom surface 21; and proportionally adjusting the ice-skate footwear 10 between a low-speed mode and a high-speed mode based upon a single user input. The first reciprocating linear path 28 is equal to the second and third reciprocating linear paths 29, 30 respectively.

In use, the method further includes the step of the adapting the ice-skate 10 to the high-speed mode by linearly displacing the first blade 22 to a fully extended anterior position while the second and third reciprocating linear paths 29, 30 have respective maximum values defined between the second and third blades 24, 25 and the lateral sides 31 respectively. The method further includes the step of adapting the ice-skate footwear 10 to the low-speed mode by linearly displacing the first blade 22 to a fully retracted posterior position while the second and third reciprocating linear paths 29, 30 have a minimum value between the second and third blades 24, 25 and the lateral sides 31 respectively.

In use, the method further includes the steps of: providing and configuring a rotary dial 32 along an exterior wall 52 of the foot-retaining section 21; and providing and statically coupling a first linear shaft 33 to the rotary dial 32 such that the first linear shaft 33 is rotatable in sync therewith. The first linear shaft 33 has a threaded outer surface 34 extending along a longitudinal length thereof and is oriented at a first angular direction. The steps further include: providing and statically coupling a rotary gear 32 to a distal end 37 of the first linear shaft 33 such that the rotary gear 32 is rotatable in sync therewith. The rotary gear 32 has a toothed outer circumference 38 and further is medially interposed between the first and second blades 24, 25. The steps further include: providing and statically coupling a second linear shaft 39 to the rotary gear 32 such that the second linear shaft 39 is rotatable in sync therewith. The second linear shaft 39 has a threaded outer surface 40 extend along a longitudinal length thereof and is oriented at a second angular direction, and is further oriented parallel to the first linear shaft 33.

In use, the steps further include: providing and connecting first and second stabilizing rods 50, 51 to the lateral sides 31 of the bottom surface 21 such that the first and second stabilizing rods 50, 51 are registered orthogonal to the second and third blades 24, 25 respectively; and linearly reciprocating the second and third blades 24, 25 linearly reciprocate along the second and third reciprocating linear paths 29, 30 by articulating the rotary dial 32 along an arcuate path respectively such that the second and third blades 24, 25 simultaneously travel towards and away from the rotary gear 32 when the rotary dial 32 is articulated along clockwise and counter clockwise directions respectively.

In use, the method further includes the steps of: providing a rectilinear track 43 formed along the bottom surface 21 of the foot-retaining section 20; providing and operably mating a third shaft 44 directly, without the use of intervening elements, with the rotary gear 32 in such a manner; and articulating the rotary gear 32 along clockwise and counter clockwise directions respectively and thereby linearly reciprocating the third shaft 44 along the track 43 and the first reciprocating linear path 28.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An ice-skate footwear for assisting a novice user to maintain balance and stability during ice-skating procedures, said multi-blade ice-skate footwear comprising:

a foot-retaining section having a substantially planar bottom surface;

a first blade adjustably connected to an anterior portion of said bottom surface;

second and third blades adjustably connected to a posterior portion of said bottom surface and being spaced from said first blade respectively; and means for selectively biasing said first blade along a first reciprocating linear path while simultaneously biasing said second and third blades along second and third reciprocating linear paths respectively.

2. The ice-skate footwear of claim 1, wherein said first reciprocating linear path is equal to said second and third reciprocating linear paths respectively;

wherein said selectively biasing means automatically displaces said first blade along said bottom surface while synchronously displacing said second and third blades along said bottom surface and thereby proportionally adjusts said ice-skate footwear between a low-speed mode and a high-speed mode based upon a single user input.

3. The ice-skate footwear of claim 2, wherein said high-speed mode is defined when said first blade is linearly displaced to a fully extended anterior position while said second and third reciprocating linear paths have respective maximum values defined between said second and third blades and said lateral sides respectively.

4. The ice-skate footwear of claim 2, wherein said low-speed mode is defined when said first blade is linearly displaced to a fully retracted posterior position while said second and third reciprocating linear paths have a minimum value between said second and third blades and said lateral sides respectively.

5. The ice-skate footwear of claim 2, wherein said selectively biasing means comprises:

a rotary dial configured along an exterior wall of said foot-retaining section;

a first linear shaft statically coupled to said rotary dial and being rotated in sync therewith, said first linear shaft having a threaded outer surface extending along a longitudinal length thereof and being oriented at a first angular direction;

a rotary gear statically coupled to a distal end of said first linear shaft and being rotated in sync therewith, said rotary gear having a toothed outer circumference and further being medially interposed between said first and second blades;

a second linear shaft statically coupled to said rotary gear and being rotated in sync therewith, said second linear shaft having a threaded outer surface extend along a longitudinal length thereof and being oriented at a second angular direction, said second linear shaft being oriented parallel to said first linear shaft; and first and second stabilizing rods connected to said lateral sides of said bottom surface and being registered orthogonal to said second and third blades respectively;

wherein said second and third blades linearly reciprocate along said second and third reciprocating linear paths when said rotary dial is articulated along an arcuate path respectively such that said second and third blades simultaneously travel towards and away from said rotary gear when said rotary dial is articulated along clockwise and counter clockwise directions respectively.

6. The ice-skate footwear of claim 5, wherein said selectively biasing means further comprises:

a rectilinear track formed along said bottom surface of said foot-retaining section; and a third shaft operably and directly mated with said rotary gear in such a manner that said third shaft is linearly reciprocated along said track and said first reciprocating linear path when said rotary gear is articulated along clockwise and counter clockwise directions respectively.

7. An ice-skate footwear for assisting a novice user to maintain balance and stability during ice-skating procedures, said multi-blade ice-skate footwear comprising:

a foot-retaining section having a substantially planar bottom surface;

a first blade adjustably connected to an anterior portion of said bottom surface;

second and third blades adjustably connected to a posterior portion of said bottom surface and being spaced from said first blade respectively; and means for selectively biasing said first blade along a first reciprocating linear path while simultaneously biasing said second and third blades along second and third reciprocating linear paths respectively;

wherein said second and third linear reciprocating paths are mutually exclusive and non-overlapping with said first linear reciprocating path;

wherein said second and third linear reciprocating paths are registered orthogonal to said first linear reciprocating path respectively.

8. The ice-skate footwear of claim 7, wherein said first reciprocating linear path is equal to said second and third reciprocating linear paths respectively;

wherein said selectively biasing means automatically displaces said first blade along said bottom surface while synchronously displacing said second and third blades along said bottom surface and thereby proportionally adjusts said ice-skate footwear between a low-speed mode and a high-speed mode based upon a single user input.

9. The ice-skate footwear of claim 8, wherein said high-speed mode is defined when said first blade is linearly displaced to a fully extended anterior position while said second and third reciprocating linear paths have respective maximum values defined between said second and third blades and said lateral sides respectively.

10. The ice-skate footwear of claim 8, wherein said low-speed mode is defined when said first blade is linearly displaced to a fully retracted posterior position while said second and third reciprocating linear paths have a minimum value between said second and third blades and said lateral sides respectively.

11. The ice-skate footwear of claim 8, wherein said selectively biasing means comprises:

a rotary dial configured along an exterior wall of said foot-retaining section;

a first linear shaft statically coupled to said rotary dial and being rotated in sync therewith, said first linear shaft having a threaded outer surface extending along a longitudinal length thereof and being oriented at a first angular direction;

a rotary gear statically coupled to a distal end of said first linear shaft and being rotated in sync therewith, said rotary gear having a toothed outer circumference and further being medially interposed between said first and second blades;

a second linear shaft statically coupled to said rotary gear and being rotated in sync therewith, said second linear shaft having a threaded outer surface extend along a longitudinal length thereof and being oriented at a second angular direction, said second linear shaft being oriented parallel to said first linear shaft; and first and second stabilizing rods connected to said lateral sides of said bottom surface and being registered orthogonal to said second and third blades respectively;

wherein said second and third blades linearly reciprocate along said second and third reciprocating linear paths when said rotary dial is articulated along an arcuate path respectively such that said second and third blades simultaneously travel towards and away from said rotary gear when said rotary dial is articulated along clockwise and counter clockwise directions respectively.

12. The ice-skate footwear of claim 11, wherein said selectively biasing means further comprises:

a rectilinear track formed along said bottom surface of said foot-retaining section; and a third shaft operably and directly mated with said rotary gear in such a manner that said third shaft is linearly reciprocated along said track and said first reciprocating linear path when said rotary gear is articulated along clockwise and counter clockwise directions respectively.

13. A method for assisting a novice user to maintain balance and stability during ice-skating procedures, said multi-blade ice-skate footwear comprising the steps of:

a. providing a foot-retaining section having a substantially planar bottom surface;

b. providing and adjustably connecting a first blade to an anterior portion of said bottom surface;

c. providing and adjustably connecting second and third blades to a posterior portion of said bottom surface by spacing said second and third blades from said first blade respectively; and d. selectively biasing said first blade along a first reciprocating linear path while simultaneously biasing said second and third blades along second and third reciprocating linear paths respectively; wherein said second and third linear reciprocating paths are mutually exclusive and non-overlapping with said first linear reciprocating path; wherein said second and third linear reciprocating paths are registered orthogonal to said first linear reciprocating path respectively.

14. The method of claim 13, wherein step d. comprises the steps of:

i. automatically displaces said first blade along said bottom surface while synchronously displacing said second and third blades along said bottom surface; and ii. proportionally adjusting said ice-skate footwear between a low-speed mode and a high-speed mode based upon a single user input; wherein said first reciprocating linear path is equal to said second and third reciprocating linear paths respectively.

15. The method of claim 14, wherein step ii. comprises the step of said adapting said ice-skate to said high-speed mode by performing the following step linearly displacing said first blade to a fully extended anterior position while said second and third reciprocating linear paths have respective maximum values defined between said second and third blades and said lateral sides respectively.

16. The method of claim 14, wherein step ii. further comprises: the step of adapting said ice-skate footwear to said low-speed mode by performing the following step linearly displacing said first blade to a fully retracted posterior position while said second and third reciprocating linear paths have a minimum value between said second and third blades and said lateral sides respectively.

17. The method of claim 14, wherein step d. further comprises the steps of:

providing and configuring a rotary dial along an exterior wall of said foot-retaining section;

providing and statically coupling a first linear shaft to said rotary dial such that said first linear shaft is rotatable in sync therewith, said first linear shaft having a threaded outer surface extending along a longitudinal length thereof and being oriented at a first angular direction;

providing and statically coupling a rotary gear to a distal end of said first linear shaft such that said rotary gear is rotatable in sync therewith, said rotary gear having a toothed outer circumference and further being medially interposed between said first and second blades;

providing and statically coupling a second linear shaft to said rotary gear such that said second linear shaft is rotatable in sync therewith, said second linear shaft having a threaded outer surface extend along a longitudinal length thereof and being oriented at a second angular direction, said second linear shaft being oriented parallel to said first linear shaft;

providing and connecting first and second stabilizing rods to said lateral sides of said bottom surface such that said first and second stabilizing rods are registered orthogonal to said second and third blades respectively;

linearly reciprocating said second and third blades linearly reciprocate along said second and third reciprocating linear paths by articulating said rotary dial along an arcuate path respectively such that said second and third blades simultaneously travel towards and away from said rotary gear when said rotary dial is articulated along clockwise and counter clockwise directions respectively.

18. The method of claim 17, wherein step d. further comprises the steps of:

providing a rectilinear track formed along said bottom surface of said foot-retaining section;

providing and operably mating a third shaft directly with said rotary gear in such a manner; and articulating said rotary gear along clockwise and counter clockwise directions respectively and thereby linearly reciprocating said third shaft along said track and said first reciprocating linear path.

* * * * *